US005200933A

United States Patent [19]

Thornton et al.

[11] Patent Number: 5,200,933

[45] Date of Patent: Apr. 6, 1993

[54] HIGH RESOLUTION DATA ACQUISITION

[75] Inventors: Glenn W. Thornton; Kenneth R. Fuller, both of Los Alamos, N. Mex.

[73] Assignee: The United States of America as represented by the United States Department of Energy, Washington, D.C.

[21] Appl. No.: 889,565

[22] Filed: May 28, 1992

[51] Int. Cl.[5] ..... G04F 8/00; G04F 10/00

[52] U.S. Cl. ..... 368/113; 368/118

[58] Field of Search ..... 368/113, 117, 118, 120; 328/185; 364/509

[56] References Cited

U.S. PATENT DOCUMENTS

| | | | |
|---|---|---|---|
| 4,079,315 | 3/1978 | Mohr | 324/186 |
| 4,242,637 | 12/1980 | Ferguson | 328/110 |
| 4,433,919 | 2/1984 | Hoppe | 368/120 |
| 4,439,046 | 3/1984 | Hoppe | 368/120 |
| 4,772,843 | 9/1988 | Asaka et al. | 320/1 |
| 4,841,497 | 6/1989 | Bateman et al. | 368/113 |

OTHER PUBLICATIONS

J. Kalisz et al., "Error Analysis and Design of the Nutt Time-Interval Digitiser with Picosecond Resolution", J. Phys. E:Sci Insrum. 20:1330 (1987).

J. Kostamovaara et al., "Time-To-Digital Converter with an Analog Interpolation Circuit", Rev. Sci. Instrum. 57(11):2880 (1986).

*Primary Examiner*—Vit W. Miska

*Attorney, Agent, or Firm*—Ray G. Wilson; Paul D. Gaetjens; William R. Moser

[57] ABSTRACT

A high resolution event interval timing system measures short time intervals such as occur in high energy physics or laser ranging. Timing is provided from a clock (38) pulse train (37) and analog circuitry (44) for generating a triangular wave (46) synchronously with the pulse train (37). The triangular wave (46) has an amplitude and slope functionally related to the time elapsed during each clock pulse in the train. A converter (18, 32) forms a first digital value of the amplitude and slope of the triangle wave at the start of the event interval and a second digital value of the amplitude and slope of the triangle wave at the end of the event interval. A counter (26) counts the clock pulse train (37) during the interval to form a gross event interval time. A computer (52) then combines the gross event interval time and the first and second digital values to output a high resolution value for the event interval.

13 Claims, 6 Drawing Sheets

HIGH RESOLUTION DATA ACQUISITION

This invention is the result of a contract with the Department of Energy (Contract No. W-7405-ENG-36).

BACKGROUND OF THE INVENTION

The present invention generally relates to measuring the duration of an event and, more particularly, to providing a high resolution measurement of the duration of closely spaced events.

There are many instances when the duration of an event must be measured with a high precision where the duration is measured in nanoseconds. Event examples include high energy nuclear physics events and laser ranging. One type of straight-forward counter simply generates high frequency pulses and counts the pulses. The resolution is inversely proportional to the pulse frequency, e.g., ±10 ns for a 100 MHz clock and is too coarse for precision work.

An improved time interval resolution can be obtained by interpolating the time elapsed between clock pulses. In one interpolation technique, a vernier approach is used to generate interpolation intervals. For example, U.S. Pat. No. 4,433,919, issued Feb. 28, 1984, to Hoppe, teaches the use of tapped delay lines wherein the difference between a start/stop pulse and an internal clock pulse can be provided from the tap outputs and combined with a gross clock count to derive a high resolution measurement. The tapped delay lines are read after the event is completed so that event repetition is limited.

In another interpolation technique, time stretching is used, e.g., by capacitor charging and discharging. A capacitor may be charged through a low resistance circuit so that an appreciable charge can be stored during a pulse interval. The capacitor is thereafter discharged through a high resistance circuit to stretch the discharge time. The discharge time is a measure of the stored charge and, hence, the time during which the capacitor was charged. See, e.g., J. Kalisz et al., "Error Analysis and Design of the Nutt Time-Interval Digitiser with Picosecond Resolution," J. Phys. E:Sci. Instrum. 20:1330 (1987). The time for making a measurement must include the "stretched" time required to discharge the capacitors and obtain the desired delay information.

Yet another approach provides for charging/discharging capacitors during intervals corresponding to the time between start/stop pulses and system clock pulses. The voltage on the capacitor can then be converted to an interpolation interval. See, e.g., J. Kostamovaara et al., "Time-to-Digital Converter with an Analog Interpolation Circuit," Rev. Sci. Instrum. 57(11):2880 (1986).

The problem of obtaining repetitive high resolution time interval measurements is addressed by the present invention and it is an object of the present invention to provide a time interval measurement circuit for closely spaced events.

It is another object of the present invention to provide synchronous internal waveforms for both gross time interval determinations and start/stop interpolation time intervals.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF INVENTION

To achieve the foregoing and other objects, and in accordance with the purposes of the present invention, as embodied and broadly described herein, the apparatus of this invention may comprise a system for high resolution event interval timing. A system clock generates a clock pulse train. A triangle wave means generates an analog triangle wave having an amplitude and slope functionally related to time elapsed during each clock pulse in the train. A converter forms a first digital value of the amplitude and slope of the triangle wave at the start of the event interval and a second digital value of the amplitude and slope of the triangle wave at the end of the event interval. A counter means counts the clock pulse train during the event interval to form a gross event interval time. A computer then combines the gross event interval time and the first and second digital values to output a high resolution value for the event interval.

In another characterization of the present invention, a method is provided for determining event interval times with high resolution. The method includes generating a system clock pulse train and generating an analog triangle wave having an amplitude and slope functionally related to time elapsed during each clock pulse in the train. At the start of an event interval, a first digital value of the amplitude and slope of the triangle wave is formed. The clock pulses are counted during the event interval to form a gross event time and a second digital value of the amplitude and slope of the triangle wave is formed at the end of the event interval. By combining the gross event time and the first and second digital values, a high resolution value is obtained and output for the event interval.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
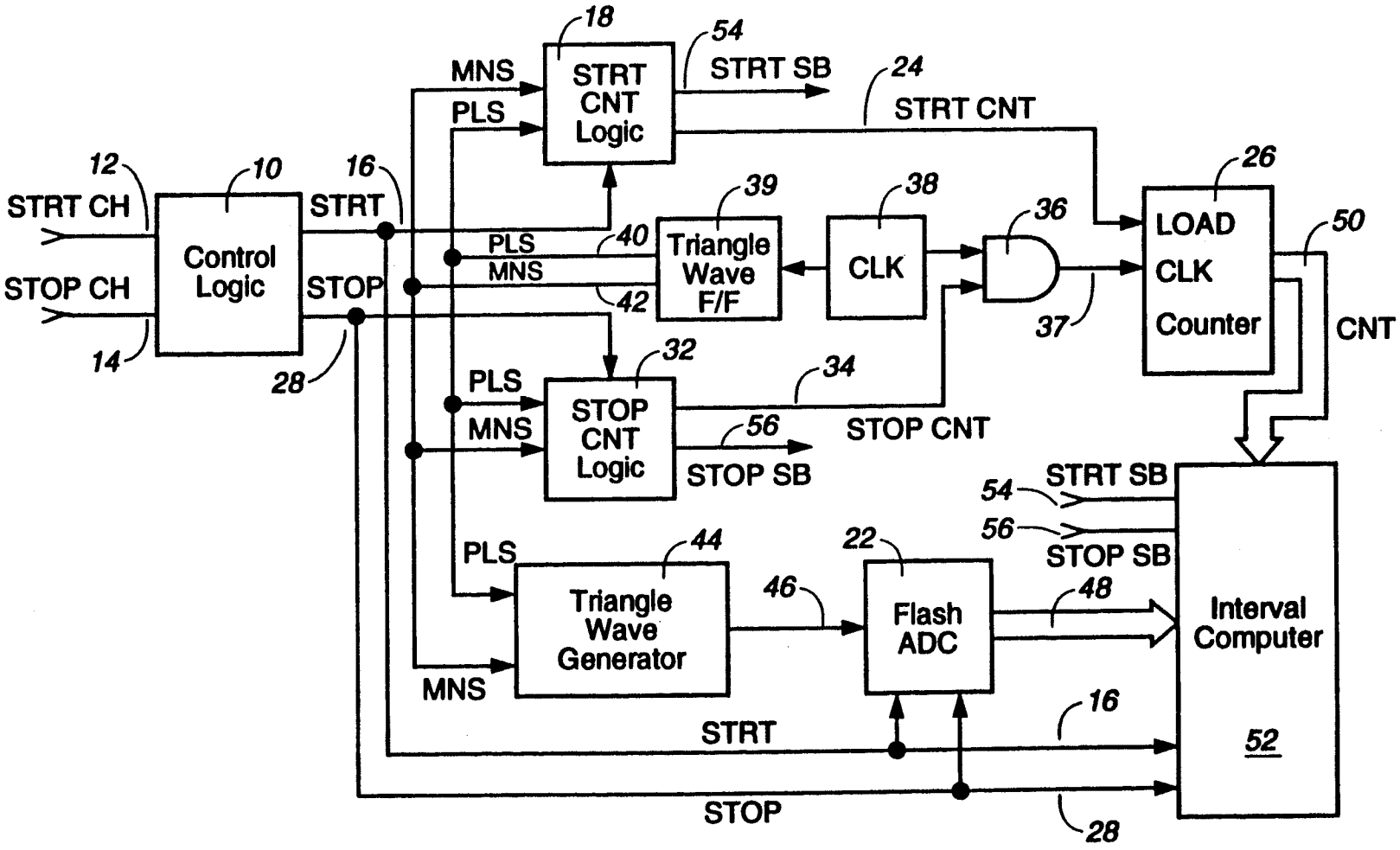
FIG. 1 is a schematic block diagram of a high resolution event timer according to the present invention.

Referring first to FIG. 1, there is shown in block diagram form a schematic of a high resolution event interval timer according to the present invention. The system is event driven through control logic circuit 10 with timing data generated by system clock 38 and synchronous triangle wave generator 44. Both clock 38 and triangle wave generator 44 run continuously and synchronously, where clock 38 provides gross timing information and triangle wave generator 44 provides interpolating time information. Flash analog-to-digital converter (ADC) 22 digitizes amplitude information from the triangle wave in real time to allow repetitive events to be timed.

The receipt of an event start signal STRT CH 12 clocks control logic 10 to output a start pulse STRT 16. STRT 16 triggers flash ADC 22 to digitize the triangle wave amplitude signal 46 from triangle wave generator 44. STRT 16 also enables start count logic circuit 18 to output a signal STRT CNT 24 to enable counter 26 to accept clock inputs. Logic circuit 18 further outputs a signal STRT SB 54 indicating the slope of the triangle wave 46, i.e., which half of the triangle wave is being generated, as a function of the state of PLS 40 and MNS 42 at the time STRT 16 is input to start count logic circuit 18. As hereinafter explained, PLS 40 and MNS 42 control the triangle wave slope and the relative polarity of PLS 40 and MNS 42 are indicative of the slope direction at any time.

The output of start count logic circuit 18 is signal STRT CNT 24 to counter 26, which enables counter 26 to count pulses 37 from clock 38 arriving at the clock input. Counter 26 is driven by system clock 38 through AND gate 36 and clock pulses are throughput as long as the stop count signal STOP CNT 34 is present. When an event stop signal STOP CH 14 arrives, control logic 10 outputs a stop pulse STOP 28 to enable stop control logic 32 to output STOP CNT 34 and STOP SB 56. Stop control logic 32 acts to remove STOP CNT 34 from AND gate 36 and stop the clock 38 throughput to counter 26. Control logic 32 also outputs signal STOP SB 56 indicating the slope of the triangle wave 46 at the time STOP is input to stop control logic 32. Signal STOP 28 triggers flash ADC 22 to digitize the amplitude of triangle wave 46 at the end of the timed event.

Thus, the basic data provided to interval computer 52 are the gross event interval clock count CNT 50, start and stop triangle wave digitized amplitudes 48, start sign bit STRT SB 54, and stop sign bit STOP SB 56. Interval computer 52 processes these data as discussed below to output a high precision event interval time.

Figure 2:
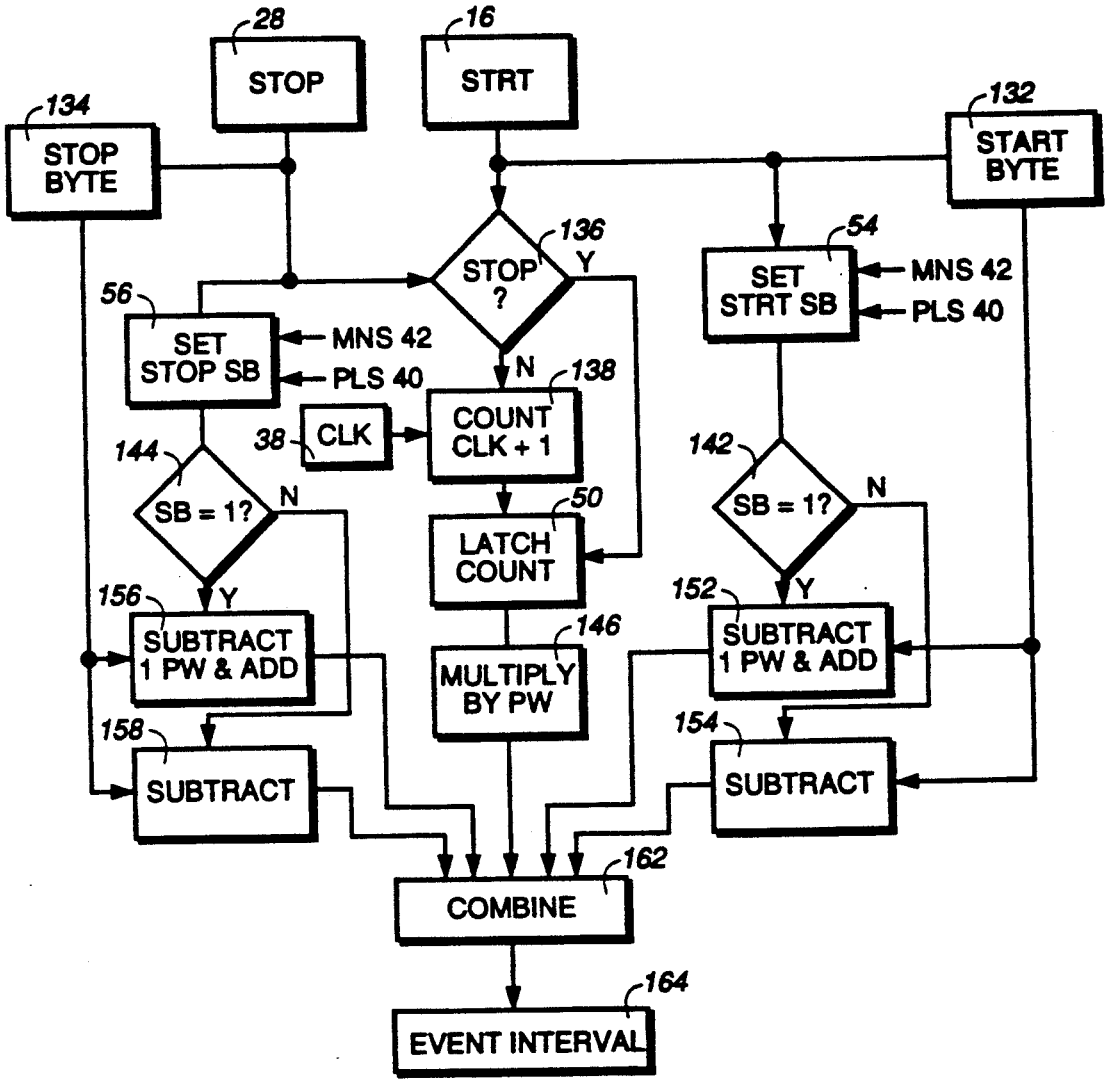
FIG. 2 is a flow diagram of the process performed by the event timer shown in FIG. 1.

The data gathering and analysis method performed by the circuit shown in FIG. 1 is depicted in flow diagram form in FIG. 2. The presence of a start pulse STRT 16 enables clock pulses 38 to be counted 138 provided 136 that a STOP pulse 28 is not present. The occurrence of STRT 16 is detected by the counter as a preload count of one so the count 138 is one greater than the clock pulse count. STRT 16 also sets the sign bit STRT SB 54 for the slope of the triangle wave. In one embodiment, a sign bit STRT SB 54 of zero indicates a positive slope (increasing amplitude) and a sign bit of one indicates a negative slope STRT 16 also causes the triangle wave amplitude to be digitized to form START BYTE 132.

The detection of the end of the event interval generates STOP 28 which is input to the STOP query 136 to produce an output effective to latch 50 the clock pulse count 138. STOP 28 also sets the sign bit STOP SB 56 for the slope of the triangle wave and causes the triangle wave amplitude to be digitized to form STOP BYTE 134. In one embodiment, a sign bit STOP SB 56 value of one indicates a positive slope and a value of zero indicates a negative slope.

The data are now combined 162 to form the high resolution event interval 164. At the occurrence of STRT 16, there are only two values for STRT SB 54: either one (PLS 40 trigger) or zero (MNS 42 trigger). The rise and fall times of the triangle wave are each equal to one full period of SYS CLK 38 and the translation of the triangle wave amplitude into an interpolation value depends on the value of the sign bit. The occurrence of SB=0 means that STRT 16 represents the time elapsed from the beginning of a clock period and START BYTE 132 is assigned a negative value to be combined 154, i.e., subtracted, from the gross event interval time 146. The occurrence of SB=1 means that START BYTE 132 represents the time remaining until the next clock period. Consequently, the interpolation factor 152 is the positive START BYTE 132 and the negative of the clock period value.

The interpolation of STOP 28 is the same as STRT 16 since the next recurring pulse from clock 38 is counted after STOP 28 is received. Thus, the occurrence of SB=1 144 sets interpolation 156 as the addition of STOP BYTE 134 and the negative of one clock period value. The occurrence of SB=0 144 sets interpolation 158 as the value of STOP BYTE 134 for subtraction. The data are combined 162 to derive the event interval 164 to a precision determined by the resolution available from flash ADC 22 (FIG. 1).

Figure 3A:
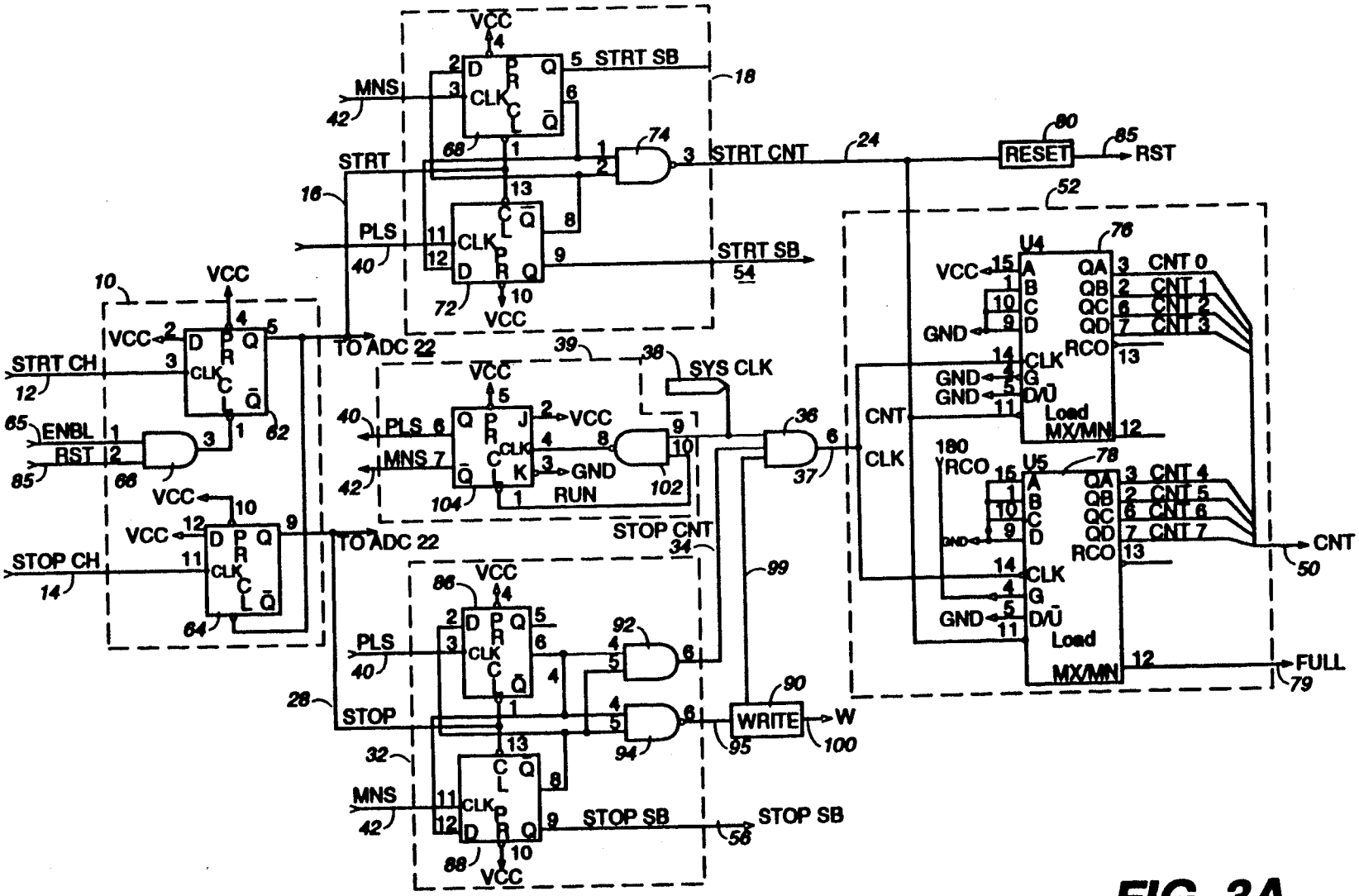
FIG. 3A is a schematic diagram of control logic and counting circuitry according to the present invention.

FIG. 3A depicts a schematic diagram of the control logic and counting circuits shown in FIG. 1, i.e., control logic 10, start count logic 18, stop count logic 32, triangle wave flip-flop 39, and counter 52. Set-up of the circuit is accomplished with a reset signal RST 85 and enable input ENBL 65. ENBL 65 is an external signal to ensure that the circuit is properly reset when the system is turned on or to force a system reset during operation if the need arises. The circuit is initialized by holding either RST 85 or ENBL 65 low to create a reset condition within the circuit. In accordance with the present invention, the circuit can be initialized to receive successive events in a very short time, e.g., <100 ns. The operational reset input RST 85 ensures that start count logic 18 and stop count logic 32 are cleared and that counter 52 is held in the load condition.

When ENBL 65 goes high following a high value for RST 85, the circuit is enabled to accept new events for interval timing. Start flip-flop (F/F) 62 is enabled while stop F/F 64 is held in a cleared condition by the Q output of start F/F 62. The first STRT CH 12 input triggers start F/F 62 to output STRT 16, which enables stop F/F 64. STRT 16 also clocks ADC 22 to digitize the triangle wave amplitude, as discussed above, and enables F/F 68 and F/F 72 in start count logic 18. Both sign bit capture functions START SB 54 and STOP SB 56 and the triangle wave current mode switches 116, 118 (FIG. 4) are driven by MNS 42 and PLS 40 inputs from F/F 104. Sign bit capture and lock-out (no further change in sign bit) occurs when a first positive edge is detected by either F/F 68 or F/F 72, i.e., when the slope of the triangle wave changes, as discussed below.

STRT SB 54 is set to zero if a MNS 42 pulse occurs, that is, the triangle slope had been positive when STRT 16 occurred, and is set to one if a PLS 40 pulse occurs, that is, the triangle slope had been negative when STRT 16 occurred. Sign bit capture also generates an output through NAND gate 74, STRT CNT 24, to enable counters 76 and 78. The counters are pre-loaded to a count of one because STRT CNT 24 is a de-facto first count.

Clock 38 provides a clock pulse train to AND gate 36 which is transmitted to counters 76 and 78 since write logic 90 and stop count logic 32 provides an input to AND gate 36 until the arrival of STOP 28. The arrival of signal STOP CH 14 at the termination or end of the event being timed generates STOP 28. STOP 28 also clocks ADC 22 to again digitize the amplitude of the triangle wave. As explained below, ADC 22 retains the digitized triangle wave amplitude values from both STRT 16 and STOP 28. Stop count logic circuit 32 operates identically with start count logic circuit 18. Stop sign bit capture also results in counter shutdown by the removal of the enabling input from AND gate 92 to AND gate 36. F/F's 86 and 88 are clocked by the next arriving PLS 40 or MNS 42 after being enabled by STOP 28. STOP SB 56 is captured in the same manner as STRT SB 54 to latch the slope of the triangle wave at the time STOP 28 occurs.

Clock 38 also clocks F/F 104 through NAND gate 102 to alternately output PLS 40 and MNS 42. As explained below, PLS 40 and MNS 42 act to switch the triangle wave slope between rising and falling conditions and to simultaneously establish the sign bit, i.e., the slope condition, when STRT 16 or STOP 28 has occurred.

ADC 22 (FIG. 1) is preferably a flash ADC, i.e., an ADC that can very quickly encode an input analog signal, e.g., in 10–20 ns. A suitable ADC is AD9058, available from Analog Devices, Inc., providing dual 8-bit analog-to-digital capability to latch both the start value of the triangle wave and the stop value of the triangle wave. At the end of a sequence, ADC 22 will have the START 132 and STOP 134 BYTES (FIG. 2) latched and STRT SB 54, STOP SB 56, and CNT 50 will be latched, along with the raw clock pulse count in counters 76 and 78.

As shown in FIG. 3A, write circuit 90, reset circuit 80, and signal FULL 79 provide for data handling and circuit reset during and after the timed event. FIG. 3B is a schematic of a reset circuit 80 to output signal RST 85 as one input to AND gate 66 for another data input. STRT CNT 24 is input to F/F 84 through delay line 82, e.g., a 10–20 ns delay. The occurrence of either a write signal W 100 or a timing signal TM OUT 178, both explained in FIGS. 3C and 3D, below, will then cause RST 85 to go low initially. The low RST 85 causes AND gate 66 output to go low and clear F/F 62. Then STRT 16 goes low and STRT CNT 24 goes low to clear F/F 84 and return RST 85 to a high value to enable F/F 62 to accept another STRT CH 12 signal. Delay line 82 ensures that the system is initialized before F/F 62 is again enabled.

Figure 3D:
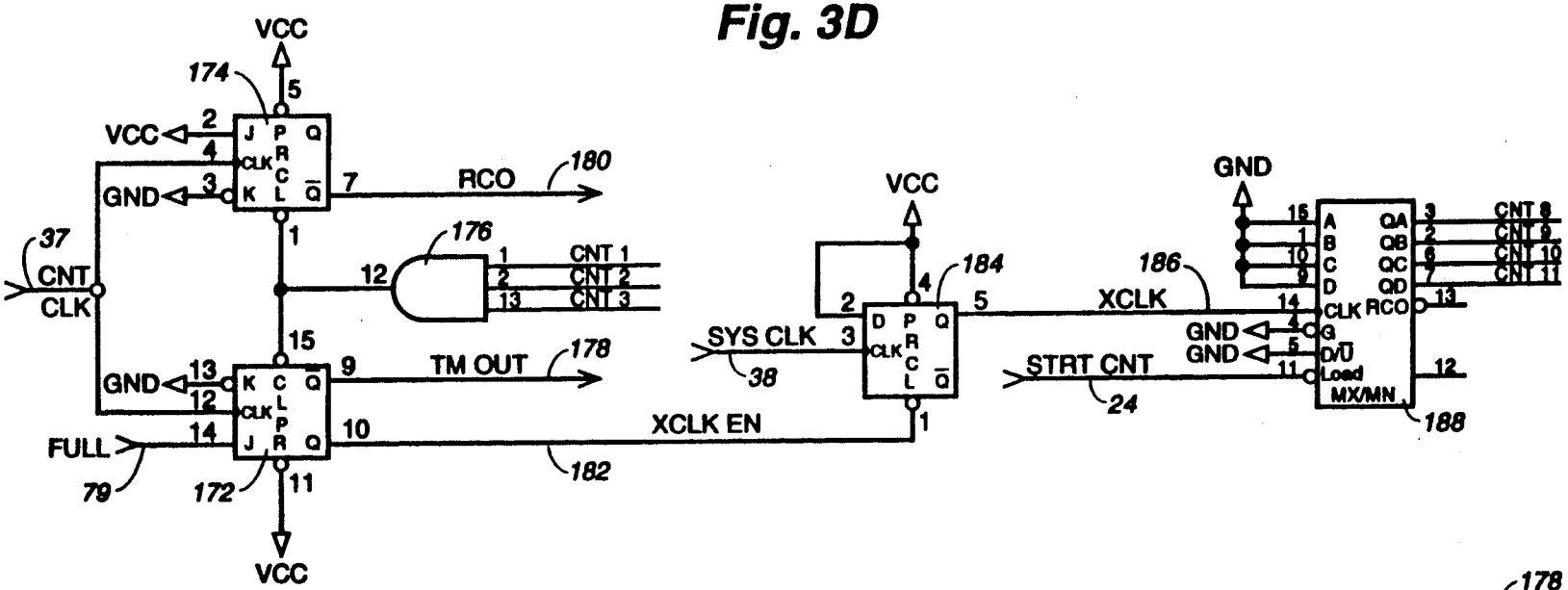
FIG. 3D is a schematic diagram of counter overflow control logic.
Figure 3B:
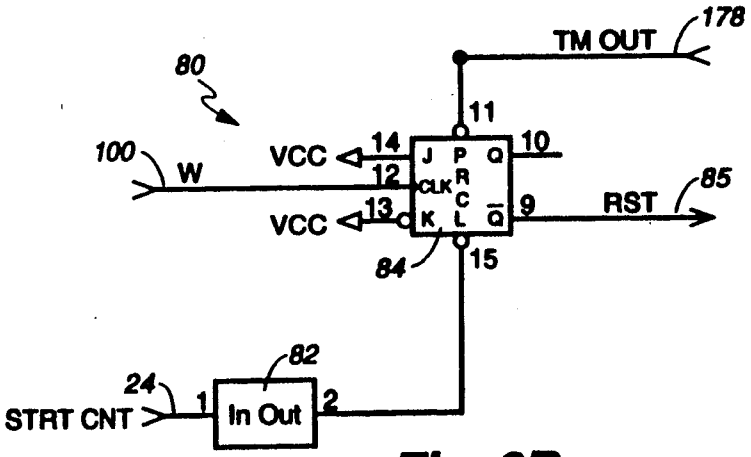
FIG. 3B is a schematic diagram of reset logic for resetting the system shown in FIG. 3A for a succeeding event.
Figure 3C:
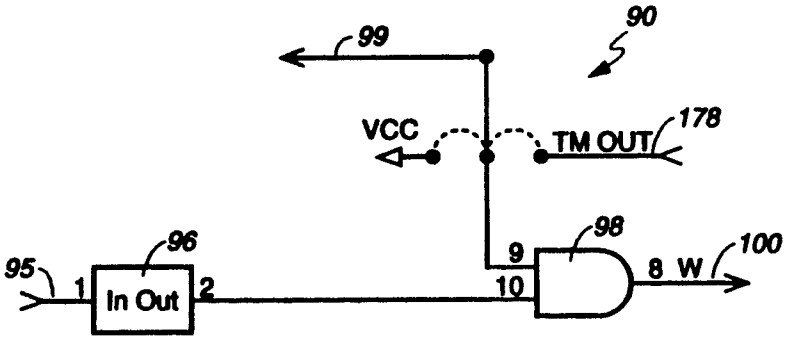
FIG. 3C is a schematic diagram of write logic for data transfer.

FIG. 3C is a circuit schematic for providing a write signal W 100 when a STOP signal is received by stop count logic 32. The output 95 of AND gate 94 is maintained low during the timed event and becomes high upon the occurrence of STOP 28 and a next-occurring PLS 40 or MNS 42 signal. Signal 95 is input through delay line 96, e g., 10–20 ns delay to ensure that counting is complete, to AND gate 98. AND gate 98 also has an input arising from the system VCC or from the timing signal TM OUT 178 so that the occurrence of signal 95 causes the write signal W 100 to be output. W 100 may be used to enable a computer, such as interval computer 52 (FIG. 1), to accept the system data for interval processing. Signal 99 is also output to AND gate 36 and, where provided, is a necessary input for clock output from AND gate 36. If TM OUT 178 goes low, i.e., the event interval exceeds a preselected maximum, counter throughput is disabled through AND gate 36 and a reset signal RST 85 is produced to prepare the circuit for a succeeding event. The circuit may be designed to use system voltage VCC in place of timing signal TM OUT 178 to form signal 99 if an expanded count is desired.

In one embodiment of the circuit design, a timing circuit is provided as shown in FIG. 3D to provide an expanded count capability. The circuit shown in FIG. 3D provides three outputs: (1) TM OUT 178 to indicate that the counters have been filled and the count data is no longer accurate; (2) XCLK EN 182 to enable F/F to be clocked by SYS CLK 38; and (3) RCO 180 to initialize counter 78 to receive CNT CLK 37.

If counters 76 and 78 become full, a subsequent clock pulse then resets the counters to zero and the output count CNT 50 no longer represents the correct gross interval time. Accordingly, counter 78 outputs a signal FULL 79 to F/F 172 when the last bit location in counter 78 is full. The F/F's 172 and 174 are enabled by the output from AND gate 176, which occurs when counter 76 needs only one additional clock pulse to be full. Then the next occurring CNT CLK 37 will cause signal RCO 180 to go low to initialize counter 78 for receiving subsequent CNT CLK 37. For high speed counting, RCO 180 is generated one pulse ahead of a similar pulse that would be output by counter 76 when it was filled and ensures that no clock pulse will be missed while counter 78 is initialized.

If counter 78 is also filled and FULL 79 is presented to F/F 172, then CNT CLK 37 will cause XCLK EN 182 to go high. XCLK EN 182 then enables the additional counter or counters by enabling F/F 184. When F/F 184 is enabled, SYS CLK 38 is throughput as XCLK 186 to overflow counter 188 to maintain an accurate gross time interval count. Counters 52 rollover to a count of zero as counter 188 advances one count. Overflow counter 188 continues to count synchronously with counters 52 . While only one overflow counter is shown, additional counters may be cascaded to provide the desired time interval measuring capacity.

Figure 4:
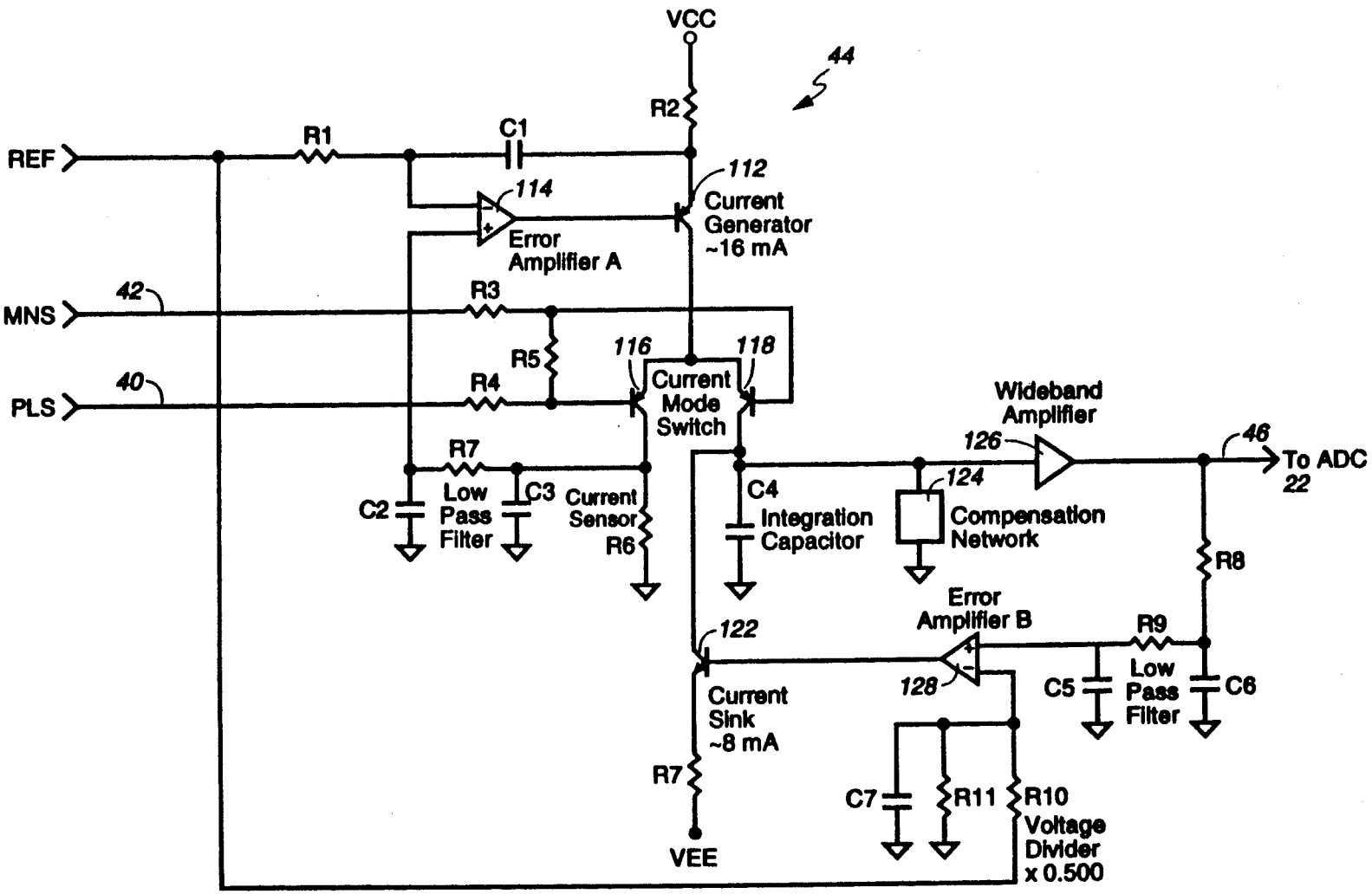
FIG. 4 is a simplified schematic diagram of a triangle wave generator according to the present invention.

Referring now to FIG. 4, there is shown a schematic diagram, in partial block diagram form, of a circuit for generating a precision triangular waveform. Basically, the precision triangular waveform generator (PTWG) uses the principal that the application of a constant current to a capacitor produces a voltage across the capacitor that increases at a linear rate proportional to the magnitude of the current.

The major components of the PTWG are a current generator 112, current mode switch 116, 118, current sink 122, and an integration capacitor C4. Current generator 112 applies a precise current directly to the current mode switch transistors 116, 118. The current mode switch is used to switch the current from current generator 112 into either current sensor resistor R6 or into integration capacitor C4 in response to PLS 40 and MNS 42 signals from triangle wave F/F 104 (see FIG.

3). If transistor 118 is switched on, current is being directed to integration capacitor C4. At the same time, current sink 122 is discharging current from capacitor C4 at a fixed rate. The rate of voltage change across integration capacitor C4 is proportional to the difference between the charging current from transistor 118 and the discharging current through transistor 122.

As shown in FIG. 4, when PLS 40 is high and MNS 42 is low, transistor 118 is switched on to charge integrating capacitor 122. In this condition, the currents are selected so that the net current into charging capacitor C4 is positive with a resulting voltage increase across capacitor C4, i.e., a positive slope on the triangle wave. Likewise, when PLS 40 is low and MNS 42 is high, transistor 116 becomes conductive and the current from generator 112 is switched through current sensor resistor R6. Now the net current into capacitor C4 is negative with a resulting negative slope on the triangle wave.

In a preferred embodiment, the current from generator 112 is twice the current from sink 122 so that the charging and discharging currents of capacitor C4 are equal. Further, PLS 40 and MNS 42 signals are periodic and of equal duration to generate a symmetric triangle waveform. By way of example, a clock signal of 40 MHz produces PLS 40 and MNS 42 signal durations of 25 ns each. If the peak amplitude of the triangle wave is controlled to be 2.5 volts, then the digitized waveform amplitude is directly related to time for use in computing the high precision event interval time. The preferred dual ADC 22 accepts input values from 0 to 250, i.e., zero to 2.5 volts in 0.01 volt increments, so that each ADC input increment represents a 100 ps resolution. The maximum/minimum values of the triangle wave, i.e., 2.5/0 volts, thus occur at 25 ns intervals to correspond with the system clock rate.

To obtain precise timing information from the triangle waveform, the amplitude of the triangle wave must be carefully controlled. Control is accomplished through error amplifier 114 to compare the reference voltage for ADC 22 (REF) with the average voltage across current sensor resistor R6 to control the bias of current generator 112 and establish a stable current output. Since the positive going slope of the triangle waveform is proportional to the current from current generator 112, current sensor resistor R6 is selected to provide a current giving the desired peak amplitude. Low pass filter C2, R7, C3 is used to eliminate the AC component of the signal present at current sensor R6 so that a true average of the current from generator 112 is obtained.

The current from current sink 122 must also be carefully controlled since the current produced by sink 122 governs the negative going slope of the triangle waveform. Error amplifier 128 compares the average voltage of the buffered triangle wave output from compensation network 124 and buffer amplifier 126 with one-half the REF value produced across voltage divider R10, R11, C7. Error amplifier 128 biases sink 122 to maintain the average current in integration capacitor C4 to produce one-half the REF value. Again, a low pass filter C5, R9, C6 eliminates any AC component in the output.

The net result according to the above embodiment is that the positive going triangle slopes are controlled to be exactly 2.5 volts in 25 ns. Thus, the triangle waveform is exactly centered at half the ADC REF value, i.e., is in the center of the range of ADC 22 and is exactly 2.50 volts peak-to-peak. It will be appreciated that other scale relationships can be established by selecting other values for REF, current sensor resistor R6, and the system clock.

The bandwidths of low pass filter C2, R7, C3 and low pass filter C5, R9, and C6 are much less than that of the triangle waveform in order to insure that the charge and discharge currents are properly controlled by error amplifiers 114 and 128, respectively. The wideband buffer amplifier 126 isolates integration capacitor C4 from ADC 22 for minimum interaction. Compensation circuitry 124 is provided to compensate for errors arising from charge injected by the current mode switch 116, 118, and the limited bandwidth of both the wideband buffer amplifier 126 and ADC 22. These errors affect mostly the fidelity of the triangle waveform at or near the apexes. The stability and accuracy of error amplifiers 114 and 128 affect the fidelity of the waveform between the apexes.

Figure 5:
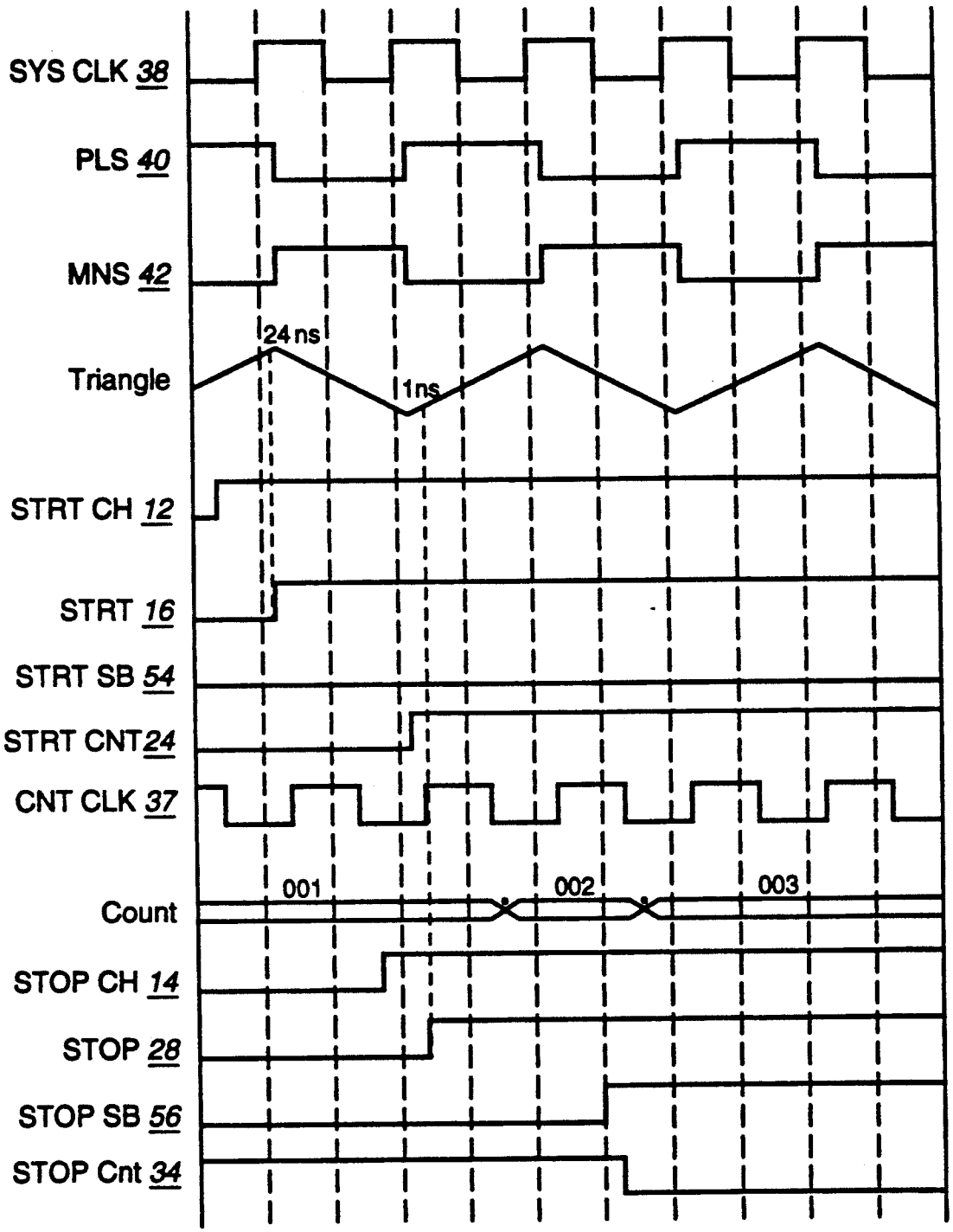
FIG. 5 is an illustrative timing diagram showing the derivation of high resolution event interval timing according to the present invention.

FIG. 5 is an exemplary timing diagram showing the acquisition of data and the derivation of a high precision event interval time as described for FIG. 2. A clock pulse train rate 38 of 40 MHz is used with a concomitant clock period of 25 ns and corresponding triangle wave ramp of 25 ns duration. The event start signal STRT CH 12 produces STRT 16 to latch STRT SB 54 as positive and to clock ADC 22 (FIG. 1) to digitize the magnitude of the triangle wave as START BYTE 132 FIG. 2), 24 ns herein. After the next clock pulse 38 has occurred, the event end signal STOP CH 14 is received to produce STOP 28 and latch STOP SB 56 as positive. Since the system is symmetric, delay times need not be included in the processing. STOP 28 also clocks ADC 22 to form STOP BYTE 134, 1 ns herein. The clock count is three: one preloaded, one occurring during the event, and one occurring after STOP CNT 34.

Processing according to the algorithm shown in FIG. 2 is as follows:

| | | |
|---|---|---|
| Clock Count 50 | 3 | |
| Gross interval time (× 25 ns) | | 75 ns |
| START BYTE 132 | 24 ns | |
| STRT SB 54 | 0 | |
| Clock count correction | 0 | 0 ns |
| Subtract START BYTE 154 | | −24 ns |
| STOP BYTE 134 | 1 ns | |
| STOP SB 56 | 1 | |
| Clock count correction | 1 | −25 ns |
| Add STOP BYTE 156 | | (−25 + 1) ns |
| COMBINE 162 | | (75 − 24 − 25 + 1) ns |
| EVENT INTERVAL 164 | | 27 ns |

While the above processing is exemplified with whole nanoseconds (ns) for simplicity, the embodiment described herein has a resolution of 0.1 ns.

It is apparent from the above description that a high resolution event timer is provided. Since both the digital clock pulses and the analog triangle wave are synchronously produced, the system does not have to clear any analog value before a subsequent pulse can be processed. Indeed, only digital outputs have to be cleared and this can be done simply by the application of suitable reset pulses after an event end signal is received. Discrete event processing can occur at several tens of MHz, a rate at least one order of magnitude above known measurement systems.

It will also be apparent to those skilled in the art that the above circuitry can be implemented in either discrete or integrated circuits. Integrated circuits are preferred in order to reduce the internal processing times and equipment size.

The foregoing description of embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. Apparatus for high resolution event interval timing, comprising:

clock means for generating a clock pulse train;

triangle wave means for generating an analog triangle wave having an amplitude and slope functionally related to time elapsed during each clock pulse in said train;

converter means for forming a first digital value of said amplitude and slope of said triangle wave at the start of said event interval and a second digital value of said amplitude and slope of said triangle wave at the end of said event interval;

counter means for counting said clock pulse train during said event interval to form a gross event interval time; and a computer for combining said gross event interval time and said first and second digital values to output a high resolution value for said event interval.

2. Apparatus according to claim 1, wherein said triangle wave means includes:

an integrating capacitor;

a constant current generator for outputting a first current for charging said integrating capacitor;

a constant current sink for outputting a second current for discharging said integrating capacitor; and switch means driven by said clock means for switching said first current to alternately increase and decrease the voltage across said integrating capacitor from said first and second currents, respectively.

3. Apparatus according to claim 2, wherein said triangle wave means further includes error amplifier means for maintaining said first and second currents at preselected values.

4. Apparatus according to claim 1, wherein said converter means includes:

start means for outputting a start signal functionally related to the beginning of said event interval;

first logic circuit means responsive to said start signal for latching a start sign bit output digital signal indicative of whether said triangle slope is positive or negative when said start signal is output;

stop means for outputting a stop signal functionally related to the beginning of said event interval;

second logic circuit means responsive to said stop signal for latching a stop sign bit output digital signal indicative of whether said triangle slope is positive or negative when said stop signal is output; and analog-to-digital converter means for latching first and second digital amplitude values of said triangle wave when said start and stop signals, respectively, are input to said analog-to-digital converter.

5. Apparatus according to claim 4, wherein said triangle wave means includes:

an integrating capacitor;

a constant current generator for outputting a first current for charging said integrating capacitor;

a constant current sink for outputting a second current for discharging said integrating capacitor; and switch means driven by said clock means for switching said first current to alternately increase and decrease the voltage across said integrating capacitor from said first and second currents, respectively.

6. Apparatus according to claim 5, wherein said triangle wave means further includes error amplifier means for maintaining said first and second currents at preselected values.

7. A method for high resolution event interval timing, comprising the steps of:

generating a clock pulse train;

generating an analog triangle wave having an amplitude and slope functionally related to time elapsed during each clock pulse in said train;

forming a first digital value of said amplitude and slope of said triangle wave at the start of said event interval;

counting said clock pulse train during said event interval to form gross event interval time;

forming a second digital value of said amplitude and slope of said triangle wave at the end of said event interval; and combining said gross event interval time and said first and second digital values to output a high resolution value for said event interval.

8. A method according to claim 7, wherein the step of generating said analog triangle wave includes the following steps:

forming a charging current effective to produce a rising voltage across an integrating capacitor;

forming a discharging current effective to produce a falling voltage across said integrating capacitor; and switching said charging current to alternately produce said rising voltage and said falling voltage across said capacitor to generate said triangle wave.

9. A method according to claim 8, further including the step of controlling said charging and discharging currents to produce a constant positive and negative slope, respectively, for said voltage across said capacitor.

10. A method according to claim 7, wherein the step of forming said first and second digital values of said triangle wave includes the steps of:

generating a first digital value indicative of whether the triangle wave slope is positive or negative; and generating a second digital value from the amplitude of said triangle wave and functionally related to the time said triangle wave has had said positive or negative slope.

11. A method according to claim 10, wherein the step of generating said analog triangle wave includes the following steps:

forming a charging current effective to produce a rising voltage across an integrating capacitor;

forming a discharging current effective to produce a falling voltage across said integrating capacitor; and switching said charging current to alternately produce said rising voltage and said falling voltage across said capacitor to generate said triangle wave.

12. A method according to claim 11, further including the step of controlling said charging and discharging currents to produce a constant positive and negative slope, respectively, for said voltage across said capacitor.

13. A high resolution event interval timer, comprising:

clock means for outputting clock pulses to said system;

triangle wave means responsive to said clock pulses for generating an analog triangle wave having an amplitude functionally related to time elapsed during each one of said clock pulses;

a counter responsive to an enabling input signal for counting said clock pulses;

converter means for converting said amplitude of said triangle wave to a digital value;

a start circuit responsive to the start of said event for generating a start output pulse to enable said counter to count said clock pulses and enable said converter to output a first digital value of said triangle wave;

a stop circuit responsive to the end of said event for generating a stop output pulse to latch said counter with the count of said clock pulses since said start output pulse and to output a second digital value of said triangle wave;

sign bit circuit means for outputting sign bit pulses functionally determined by the slope of said triangle wave when said start and stop pulses are output; and computer means for receiving said first and second digital values of said triangle wave, said latched count in said counter, and said sign bit pulses and computing the interval for said event.

* * * * *